United States Patent [19]

Finamore

[11] 4,453,555

[45] Jun. 12, 1984

[54] HAIRPIECE FOUNDATION AND METHOD OF MAKING SAME

[75] Inventor: Paul V. Finamore, Chicago, Ill.

[73] Assignee: Hairline Creations, Inc., Chicago, Ill.

[21] Appl. No.: 410,421

[22] Filed: Aug. 23, 1982

[51] Int. Cl.[3] ..... A41G 3/00

[52] U.S. Cl. ..... 132/53; 132/5; A41G/3/00

[58] Field of Search ..... 132/53, 54, 5, 9

[56] References Cited

U.S. PATENT DOCUMENTS

| | | | |
|---|---|---|---|
| 1,490,466 | 4/1924 | Hupka . | |
| 2,149,170 | 2/1939 | Gould | 132/53 UX |
| 2,736,325 | 2/1956 | Dvorzsak . | |
| 2,814,301 | 11/1957 | Schmitz . | |
| 2,907,334 | 10/1959 | LeMole . | |
| 3,037,261 | 6/1962 | Hess | 132/53 X |
| 3,420,249 | 1/1969 | Bonham | 132/53 |
| 3,421,521 | 1/1969 | Rich . | |
| 3,435,831 | 4/1969 | Nakayama et al. . | |
| 3,472,246 | 10/1969 | Ostrom . | |
| 3,520,309 | 7/1970 | Lane et al. . | |
| 3,613,695 | 10/1971 | Kazdin . | |
| 3,645,275 | 2/1972 | Nolen | 132/5 |
| 3,710,452 | 1/1973 | Hamrick | 132/53 |
| 3,716,065 | 2/1973 | Finamore | 132/53 |
| 3,971,392 | 7/1976 | Brehmer . | |

FOREIGN PATENT DOCUMENTS 1255711 12/1971 United Kingdom .

*Primary Examiner*—Gregory E. McNeill

*Attorney, Agent, or Firm*—Trexler, Bushnell & Wolters, Ltd.

[57] ABSTRACT

A hairpiece foundation, comprising a number of layers of components, is disclosed. A first component, the base layer, has a predetermined curvature and conforms substantially to the head of a human subject. A second component, a first adhesive substance, is bonded to an exterior surface of the first component. A third component, a first surface coating, is bonded to the second component. A fourth component, a second adhesive substance, is bonded to an interior surface of the base layer. A fifth component, a second surface coating, is bonded to the fourth component. A sixth component, a third adhesive substance, is bonded to the fifth component. A seventh component, a layer of thermoplastic urethane film similar to the base layer, is bonded to the sixth component.

13 Claims, 11 Drawing Figures

HAIRPIECE FOUNDATION AND METHOD OF MAKING SAME

REFERENCE TO RELATED APPLICATIONS

The present application is related to a currently pending application which is entitled "HAIRPIECE AND METHOD OF MAKING SAME" and which bears Ser. No. 347,622, having been filed Feb. 10, 1982. Such related application, which is hereby incorporated by reference, is a continuation of a parent application, entitled "HAIRPIECE AND METHOD OF MAKING SAME" also hereby incorporated by reference, having been filed Sept. 2, 1980 and bearing Ser. No. 183,071 (now abandoned), the benefit of which is now claimed with regard to 35 U.S.C. §120.

The present application, and the two related applications, have the same inventor, Paul V. Finamore; and, the present application and the two related applications have been assigned to Hairline Creations, Inc., of Chicago, Ill.

BACKGROUND OF THE INVENTION

This invention is directed to a hairpiece foundation, and more particularly, is directed to a novel hairpiece foundation and method of making such a hairpiece foundation.

Throughout this application, the terms "hair" or "hair fibers" will refer either to natural hair or to commercially available fibers, strands, threads or the like which have the appearance of natural hair.

Most commercially available hairpieces are manufactured in a manner such that the hair and the hairpiece are of one-piece construction. Accordingly, replacement of hair fibers, for any reason, is usually either impossible or commercially impracticable.

In addition, many commercially available hairpieces cannot be tinted or otherwise generally cannot have the hair color altered because of the adverse effect of the tint or coloring agent upon the hairpiece foundation.

Moreover, many commercially available hairpiece foundations are either affected by perspiration of the hairpiece wearer or are susceptible to attack by microorganisms such as fungus, mold, yeast, bacteria and the like.

Conventional hairpiece foundations are usually either flesh-like in color or are transparent so as to match the skin tones of the wearer or to blend into the wearer's scalp. The color of human scalp and surrounding surface tissue is affected by factors such as degree of lighting, sunlight and other forms of ultraviolet radiation, ambient temperature and the like. A transparent hairpiece foundation is often preferred. Yet, many transparent hairpieces have a smooth outer surface which permits refraction of light through the hairpiece foundation. Upward reflection of such refracted light, from the wearer's head, often reveals the wearer's true scalp or skin therebeneath. Accordingly, such an unnatural effect is undesirable. Yet, few commercial hairpiece foundations, if any, provide the wearer with a truly natural appearance.

OBJECTS AND SUMMARY OF THE INVENTION

Accordingly, it is a general object of this invention to provide a novel and improved hairpiece foundation.

A more specific object is to provide a novel hairpiece foundation which is adaptable to permit removal of hair fibers therefrom or replacement or addition of hair fibers thereto.

A further object is to provide such a hairpiece foundation which is unaffected by hair tinting or hair coloring agents, generally unaffected by perspiration, and generally impervious to attack from microorganisms.

Yet another object is to provide such a hairpiece foundation which is relatively thin, soft to the touch, flexible, and substantially transparent, and which has a surface adaptation that generally provides the hairpiece with a natural appearance.

Briefly, and in accordance with the foregoing objects, a novel hairpiece foundation will now be summarized. The hairpiece foundation, of the present invention, comprises a number of components or layers, all of which are commercially available.

The first or base layer is a layer of thermoplastic polyurethane film. Prior to construction of the hairpiece foundation, the first layer is usually pre-formed or otherwise adapted to conform substantially to the head of a human subject; thus, the first layer usually has a predetermined curvature. The surface of the base layer which is outwardly oriented from the head of the wearer is referred to as the base layer outer surface. The surface which is directed toward the head of the wearer is referred to as the base layer inner surface. The remainder of the components of the hairpiece foundation are built upon the base layer.

The second component is a layer of silanol-based film primer, referred to as an adhesive, which is applied, in sufficient amount, to the outer surface of the first layer for securing to such base layer a third component. The third component, generically described as an elastic organo-silicon-oxide high polymer, functions as an exterior surface or coating for the hairpiece foundation. The adhesive effectively bonds the coating to the outer surface of the base layer. After the coating has been secured to the base layer, and while the coating is still in a deformable state, the exterior or outwardly directed surface of the coating is embossed to provide the hairpiece foundation with a natural appearance resembling pores of skin. Prior to being cured, the adhesive and the coating have liquid properties. The three above-described components of the hairpiece foundation are cured, after surface embossing, by being subjected to a "controlled environment" thereby subjecting these components to a predetermined elevated temperature for a predetermined time. Such a controlled environment serves to "cure" the adhesive and the coating. Such a cure causes the adhesive and the coating to set up and solidify, yet remain soft to the touch, supple and substantially transparent. The exterior surface of the coating retains the embossed features.

After being subjected to such curing, the three initial components of the hairpiece foundation, functioning as a unit, are "ventilated" with hair fibers. That is, an individual hair fiber or hair-like strand of fibers or a collection of several fibers or of several hair-like strands of fibers is forced through the three initial components of the hairpiece foundation (thereby creating holes therethrough). The hair is then secured thereto in a known manner.

After the three above-described components of the hairpiece foundation are thus ventilated with hair fibers, a layer of a fourth component, an ethyl cyanoacrylate adhesive, is applied to the base layer inner surface. This is a "penetrating" adhesive and, in addition to forming an additional layer on the base layer inner surface, penetrates into the annular space (in the hairpiece foundation holes) surrounding the hair fibers. This penetrating (or second) adhesive is applied to the base layer inner surface in an amount sufficient to penetrate the holes, to bond individual hair fibers respectively within such holes, to coat hair fiber portions which extend from the base layer inner surface, and is otherwise generally applied to the base layer inner surface for securing the next component of the hairpiece foundation thereto. These four components are then subjected to a predetermined elevated temperature for a predetermined time to cure the fourth component.

After the fourth component has cured, at least one layer of a fifth component, a coating, generically referred to as a specialty thermoplastic urethane in solution, is applied to coat the inner or scalp-directed surface of the yet incomplete hairpiece foundation. Then, the five components are collectively subjected to a predetermined elevated temperature for a predetermined time to cure the fifth component. It may be desirable that the completed hairpiece foundation have more than one such layer of the fifth component. If this is so, the subsequent layers of the fifth component are added to the inner or scalp-directed surface of the hairpiece foundation under construction after each such preceding fifth component layer has cured.

After the inner surface of an ultimate or final fifth component layer has cured, a sixth component, an adhesive generically referred to as a polyurethane polymer in solution, is applied to the scalp-directed surface of the hairpiece foundation under construction in an amount sufficient to bond to the fifth component layer a seventh component, which is another layer of a thermoplastic polyurethane film. The solution of the sixth component includes an effective amount of molecular sieves for moisture control of the solvent mixture (of the solution) of the sixth component. The sixth component is not separately cured.

After the sixth component has been applied to the inner surface, the last (seventh) component, a thermoplastic polyurethane film, is applied onto the adhesive (the sixth component) on the inner surface. The hairpiece foundation under construction is then subjected to a predetermined elevated temperature for a predetermined time to cure the seventh component. After such curing, edges of the hairpiece foundation are then usually trimmed to the row of hair of the individual human subject to provide a finished hairpiece.

If desired, alterations to the hairpiece foundation, such as removal or addition of hair fibers, can be made by subjecting the foundation to a predetermined elevated temperature. This causes the sixth component to soften. The seventh component can then easily be removed from the foundation, and the desired alterations made.

BRIEF DESCRIPTION OF THE DRAWINGS

The foregoing, as well as other objects, features and advantages of the present invention will become more readily understood upon reading the following detailed description of the illustrated embodiment, together with reference to the drawings, wherein.

DETAILED DESCRIPTION OF THE ILLUSTRATED EMBODIMENT

Figure 1:
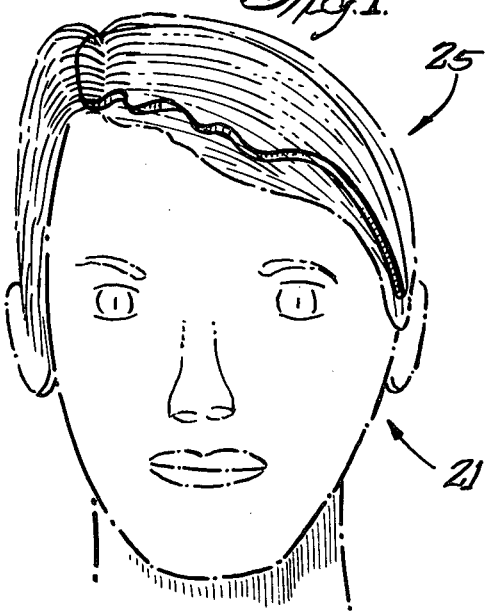
FIG. 1 is a frontal view of the novel hairpiece foundation as worn by a human subject.

Referring to the drawings, and initially to FIG. 1, the novel hairpiece foundation of the present invention will now be discussed.

A subject, referred to generally by the reference numeral 21, is selected (FIG. 1), and a first component 23 (FIG. 2) is adapted to conform to the curvature of a preselected area of the scalp of the subject 21. Methods to cause the first component 23 to assume a curvature substantially that of a preselected subject 21 are well known in the art, and the preferred method, for purposes of this application, are described in the above-referenced co-pending patent application Ser. No. 347,622, such method herein being incorporated by reference.

The preferred first component 23 is referred to generically as a thermoplastic polyurethane film. The first component 23 preferably has physical properties appearing below in Table I.

TABLE I

| GENERIC DESCRIPTION | PHYSICAL PROPERTIES | | | | | |
|---|---|---|---|---|---|---|
| | SPECIFIC GRAVITY | DUROMETER HARDNESS, SHORE A UNITS | TENSILE STRENGTH[1], psi | ELONGATION AT BREAK[2], % | TEAR PROPOGATION[3], POUNDS/INCH | APPEARANCE[4] |
| THERMO-PLASTIC POLY-URETHANE (Film) | 1.22 | 93 | 9000 | 200 | 260 | CLEAR |

[1]The tensile strength was determined by performing a test, as outlined in ASTM D882-61T MD, upon a test coupon.
[2]Elongation was determined by performing ASTM D882-61T MD upon a test coupon.
[3]Tear propagation was determined by performing ASTM D1938-62T MD upon a test coupon.
[4]A film thickness of 1 mil and of 50 mils appeared clear and transparent.

The finished hairpiece foundation (FIG. 1) is referred to generally by the reference numeral 25. The finished hairpiece foundation 25 comprises several distinctive layers of components of which, the first component 23 forms the base layer. The surface of the base layer 23, which is outwardly oriented from the head of the wearer is referred to as the base layer outer surface. The surface which is directed toward the head of the wearer is referred to as the base layer inner surface. The additional components are added to the base layer inner surface or are added to the base layer outer surface.

Before being pre-formed, the first component 23 is usually 10 mils thick initially, but the thickness generally decreases somewhat after pre-forming to the scalp curvature of the subject 21. (A mil is a unit of length equal to 1/1000 of an inch.)

Figure 3:
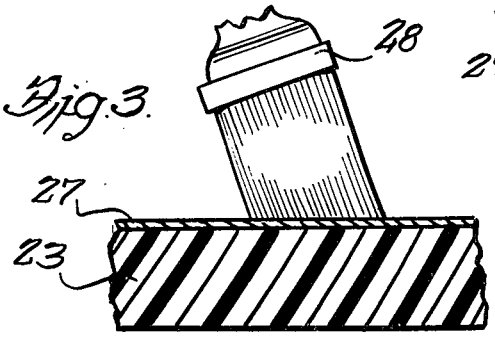
FIG. 3 is a side view, partially in section, presenting the second layer applied by brush onto the outer or outwardly-directed surface of the first layer.

A second component 27, an adhesive, is applied by a brush 28 (FIG. 3) to the outer surface of the first component 23, so that a third component 29 can be bonded to the base layer 23. The second component 27 is generically referred to as a silanol-based film primer. Several such film primers were tested, and useful ranges of film primer physical properties appear below in Table II. The preferred film primer is also presented below in Table II.

TABLE II

| GENERIC DESCRIPTION | PHYSICAL PROPERTIES | | | | | | | |
|---|---|---|---|---|---|---|---|---|
| | APPEARANCE | | SOLIDS RESIDUE, % BY WEIGHT | | VISCOSITY AT 25° C. (77° F.), CENTISTOKES | | DENSITY POUNDS/GALLONS (KILOGRAMS/ CUBIC METER) | |
| | USEFUL | PRE-FERRED | USEFUL RANGE | PREFERRED VALUE | USEFUL RANGE | PREFERRED VALUE | USEFUL RANGE | PREFERRED VALUE |
| Silanol-Based[5] Film Primer (Adhesive) | Substan-tially trans-parent | Clear & Slightly Straw-Colored | 2.5 to 10 | 5 | 1 to 5 | 2.5 | 6.6 to 7.4 (791 to 887) | 7.4 (887) |

| GENERIC DESCRIPTION | PHYSICAL PROPERTIES | | | | | |
|---|---|---|---|---|---|---|
| | FLASH POINT[6], °C. (°F.) | | SOLVENT SYSTEMS | | DILUENTS | |
| | USEFUL RANGE | PRE-FERRED VALUE | USEFUL | PREFERRED | USEFUL | PREFERRED |
| Silanol-Based[5] Film Primer (Adhesive) | 1.6 to 13.7 (35 to 57) | 1.6 (35) | Various[7] | Ethylene glycol monobutyl ether, toluene, n-butanol ethanol and ethylene glycol monomethyl ether | Various[8] | Dimethyl Formamide and Toluene |

[5]A silanol is an alchohol form of a silane. A silane is a gaseous or liquid compound of silicon and hydrogen analogous to alkanes or saturated hydrocarbons. Organofunctional silanes are noted for their ability to bond organic polymer systems to substrates.
[6]The flash point was determined using "Pensky-Martens" procedures.
[7]A first useful solvent system tested included toluene, ethylene glycol monobutyl ether, n-butanol and ethanol. A second useful solvent system tested included toluene, ethylene glycol monobutyl ether and mono- and di-alkyl ethers of ethylene glycol and their derivatives. A third useful solvent system tested included ethanol and toluene. A fourth useful solvent system tested included ethylene glycol monobutyl ether, toluene, n-butanol, ethanol and ethylene glycol monomethyl ether. A fifth useful solvent system tested included isopropyl alchohol. A sixth useful solvent system tested included ethanol, toluene and ethylene glycol monobutyl ether. A seventh useful solvent system tested included ethanol. An eighth useful solvent system tested included ethanol and isopropyl alchohol.
[8]A first useful diluent tested included toluene, methanol and ethanol. A second useful diluent tested included toluene, methanol and mono- and di-alkyl ethers of ethylene glycol and their derivatives. A third useful diluent tested included dimethyl formamide and toluene. A fourth useful diluent tested included isopropyl alchohol, methanol and ethanol. A fifth useful diluent tested included methanol and ethanol.

The second component 27 is applied substantially uniformly to the base layer 23, at an average thickness of about ½ of a mil over substantially all of the outer surface. At room temperature, the preferred second component 27 dries in about 15 minutes. Throughout this application, the term "room temperature" will be understood to mean about 77 F. (about 25 C.)°.

Figure 4:
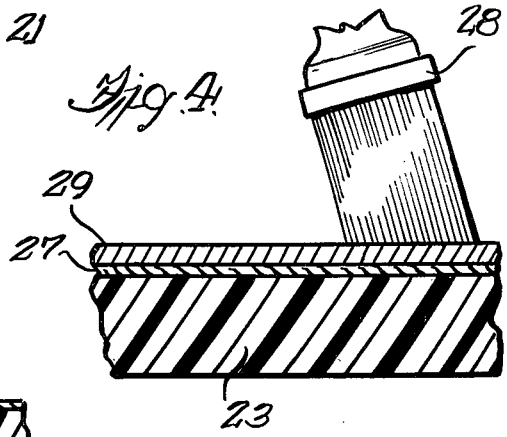
FIG. 4 is a side view, partially in section, of the third component also being applied by brush onto the outwardly directed surface of the second component.
Figure 5:
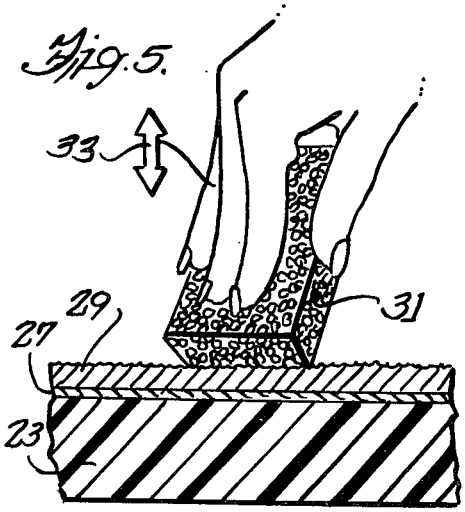
FIG. 5 is a side view of the unfinished hairpiece foundation, partially in section, presenting hand-embossing, by means of a sponge, of the outer surface of the third component.

After the second component component 27 has dried, a third component 29, a coating adhesive generically referred to as an elastic organo-silicon-oxide high polymer, is applied to the upper or outer surface of the second component 27. The third component 29 is preferably initially hand-applied by the brush 28 (FIG. 4), and while wet or semi-wet, is then hand-embossed, preferably using a sponge 31 or such, while applying gentle upward and downward pressure (as indicated by the double-headed arrow 33, presented in FIG. 5) thereby providing the third component 29 with a natural scalp appearance. After being hand-embossed, the third component 29 appears translucent. The hand-embossing provides the outer surface of the third component 29 with an appearance of naturally-formed or actual skin pores. As applied, the third component 29 has a thickness of about 2 mils, and is usually preferably less than that. The physical properties of the preferred third component 29 appear below in Table III.

TABLE III

| | PHYSICAL PROPERTIES | | | | | | |
|---|---|---|---|---|---|---|---|
| GENERIC DESCRIPTION | APPEARANCE | VISCOSITY AT 25° C. (77° F.), POISES | SPECIFIC GRAVITY[11] AT 25° C. (77° F.) | CURETIME TEMPERATURE, HOURS/°C. | RADIATION RESISTANCE[12], MEGARADS | WATER ABSORPTION[13], 7 DAYS AT 25° C. (77° F.), % | THERMAL CONDUCTIVITY[14] AT 25–100° C. (77 TO 212° F.) CALORIES PER SQUARE CENTIMETER-°C.-SECOND PER CENTIMETER |
| Elastic Organo-silicon-oxide high polymer[9] (coating) | Clear | 450[10] | 1.07 | 24/25 | 100 | 0.40 | 0.000495 |

| | PHYSICAL PROPERTIES | | | | | | |
|---|---|---|---|---|---|---|---|
| Generic DESCRIPTION | VOLUME EXPANSION FROM 25 TO 150° C. (77 TO 302° F.), CUBIC CENTIMETERS PER CUBIC CENTIMETER-°C. | SPECIFIC HEAT AT 25° C. (77° F.), CALORIES PER GRAM-°C. | TENSILE STRENGTH[15], psi | ELONGATION[16], % | DUROMETER HARDNESS VALUE[17], SHORE A, POINTS | TEAR STRENGTH[18], psi | BRITTLE POINT[19] °C. (°F.) |
| Elastic Organo-silicon-oxide high polymer[9] (Coating) | 0.00093 | 0.35 | 250 | 400 | 25 | 28 | Minus 73 (Minus 99.4) |

[9]A commercially available polymer having an overall physical characteristic comparable to milled and compounded rubber prior to vulcanization but containing organo-silicon polymers; useful temperature range is from about minus 100 to about 500 Fahrenheit (about minus 73 to about 260 Centigrade) degrees.
[10]Extrusion rate, as expressed in grams per minute, is related to viscosity measurement.
[11]Specific gravity determination was made per ASTM D 702 guidelines.
[12]A test sample was found to be generally useful after being exposed to this megarad dosage.
[13]Water absorption determination was made upon a sample using ASTM D 570 procedures.
[14]Thermal conductivity determination was made upon a test coupon using "Cenco Fitch" procedures.
[15]Tensile strength determination was made upon a test coupon using ASTM D 412 procedures.
[16]Elongation determination was made upon a test coupon using ASTM D 412 procedures.
[17]Durometer hardness determination was made upon a test coupon using ASTM D 676 procedures.
[18]Tear strength determination was made upon a test coupon using ASTM D 412 procedures.
[19]Brittle point determination was made upon a test coupon using ASTM D 746 procedures.

Figure 6:
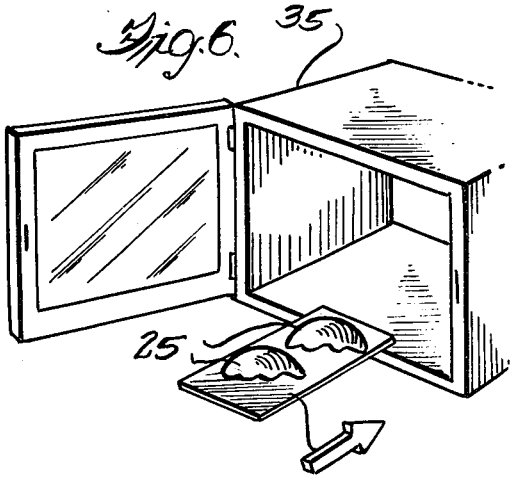
FIG. 6 is an isometric view presenting an oven which is used to cure the unfinished hairpiece foundation throughout the various stages of its manufacture.

After the third component 29 has totally been applied to the outer surface of the second component 27, these three initial components 23, 27 and 29 of the hairpiece foundation 25 are subjected to a predetermined elevated temperature for a predetermined time to cure the third component 29. An oven 35 (FIG. 6) is preferably used to provide such a cure, curing being accomplished after anywhere from 45 minutes to 2 hours at about 200 F., (about 93 C.)°. After being taken out of the oven 35, the three components 23, 27 and 29 of the hairpiece foundation 25 (under construction) cool to room temperature in about 5 to about 10 minutes.

Figure 7:
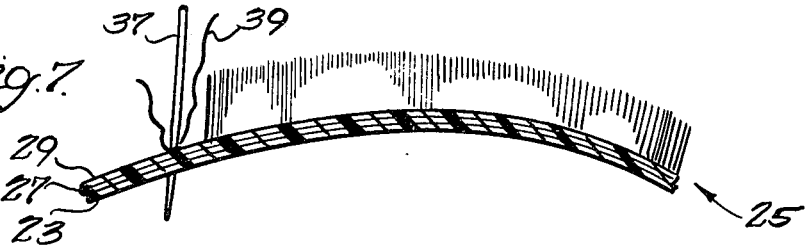
FIG. 7 is a side view, partially in section, of a preferred method of ventilating the unfinished hairpiece foundation.

Upon cooling to room temperature, the hairpiece foundation 25 under construction can be "ventilated" with hair. Ventilation of the three components 23, 27 and 29 is preferably accomplished via a needle 37 (FIG. 7) or other suitable implement employing a "pull-through" or "knotted" technique. The pull-through technique forces a single hair fiber 39 through a hole 41 (FIG. 8) which the needle 37 creates first in the third component 29 then in the second 27 and lastly in the first component 23. Then, the needle 37 is drawn through the hairpiece foundation 25 (under construction) and the needle 37 is caused to create a second hole 43 (FIG. 8) through the three components 23, 27 and 29 (preferably proximate to the first hole 41), drawing the hair fiber 39 therewith.

The knotted manner of ventilating the hairpiece foundation 25 under construction (details not shown) also preferably employs the needle 37 or other such implement to create a hole in the hairpiece foundation 25 and to similarly force several hair fibers, ususally two or three, through the three components 23, 27 and 29, as described above. Then, the short ends of the several hair fibers are knotted at the inner surface or underside of the hairpiece 25 under construction.

Although a hairpiece foundation 25 (under construction) can be uniformly ventilated with hair using either of these techniques, a finished hairpiece foundation 25 ususally has the hair fibers 39 knotted only at the perimeter or edge boundaries of the hairpiece foundation and otherwise generally has the hair fibers 39 pulled through the remainder of the hairpiece foundation 25.

It has been discovered that when the third component 29 (or exterior coating) has the physical properties outlined above in Table III, the hairpiece foundation 25

(upon being ventilated) exhibits excellent wear resistance and excellent internal strength. Furthermore, the preferred third component 29 is generally resistant to stain, discoloration, moisture, oil and attack by microorganisms.

Figure 8:
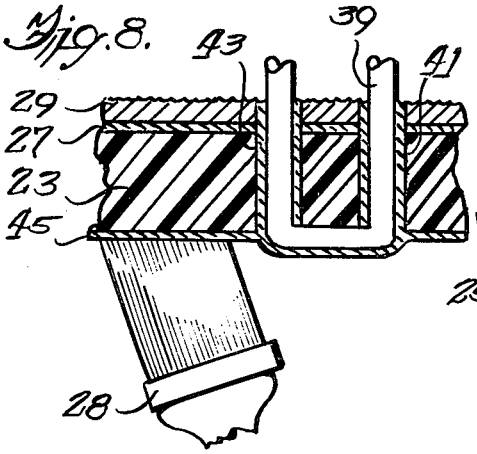
FIG. 8 is a side view, partially in section, of the unfinished hairpiece foundation after it has been ventilated with hair fibers, the view further presenting brush application of a fourth component to coat the inner or scalp-directed surface of the hairpiece foundation and to penetrate holes which were created in the hairpiece foundation as a result of the ventilation.

After the hairpiece foundation 25 (being constructed) is suitably ventilated, a fourth component 45, a penetrating adhesive, generically referred to as an ethyl cyanoacrylate adhesive, is applied by the brush 28 to the underside or scalp-directed side of the hairpiece foundation 25. The fourth component 45 penetrates the holes 41, 43, surrounds the hair fibers 39, and bonds the hair fibers 39 to the three components 23, 27 and 29 of the hairpiece foundation 25 under construction (FIG. 8). The physical properties of the preferred fourth component 45 appear below in Table IV.

TABLE IV

| GENERIC DESCRIPTION | PHYSICAL PROPERTIES LIQUID STATE: APPEARANCE | SPECIFIC GRAVITY | VISCOSITY CENTIPOISE[21] | FLASHPOINT (TCC), °C. (°F.) | GENERALLY SOLUBLE IN |
|---|---|---|---|---|---|
| Ethyl Cyanoacrylate[20] Adhesive | Colorless Liquid | 1.05 | 1 to 5 | 93.3 (200) | Various Solvents[22] |

| GENERIC DESCRIPTION | PHYSICAL PROPERTIES CURED STATE: SERVICEABLE TEMPERATURE RANGE, °C. (°F.) | REFRACTIVE INDEX, n 20° C./D | HARDNESS, BARCOL UNITS | MAXIMUM CURE TIME, HOURS | MELTING POINT °C. (°F.) | GENERALLY SOLUBLE IN | ELONGATION, % | TENSILE STRENGTH[23], psi | IMPACT SHEAR STRENGTH[24] FOOT-POUNDS PER SQUARE INCH |
|---|---|---|---|---|---|---|---|---|---|
| Ethyl Cyanoacrylate[20] (Adhesive) | Minus 53.9 to 82.2 (Minus 65 to 180) | 1.45 ± .03 | 65 | 24 | 165 (329) | Acetone | <2 | 4000 | 4 to 6 |

[20]Such ethyl cyanoacrylates are relatively low-viscosity adhesives capable of penetrating, by capillary action, between non-porous, very closely mating rubber and/or plastic parts.
[21]Viscosity determination is made by the "Brookfield" method at 25.6 Centigrade (78 Fahrenheit) degrees.
[22]Useful solvents tested were reagent grade methylethyl ketone, methylene chloride and nitromethane.
[23]Tensile strength determination was made upon steel-to-steel test coupons using ASTM D-2095-78 procedures.
[24]Impact shear strength determination was made upon steel-to-steel test coupons using ASTM-950-78 procedures.

Although the fouth component 45 can be applied to the entire underside of the hairpiece foundation 25 under construction, it is preferably applied only at the pull-through area. The thickness of the fourth component 45 at the underside of the hairpiece foundation 25 under construction is generally initially less than ½ of a mil. After the fourth component 45 is applied, the hairpiece foundation 25 is again placed into the oven 35 for about 20 to about 25 minutes at about 200° Fahrenheit (about 93° Centigrade) to cure the fourth component 45. After curing, the hairpiece foundation 25 cools to room temperature in about 5 to about 10 minutes.

Figure 9:
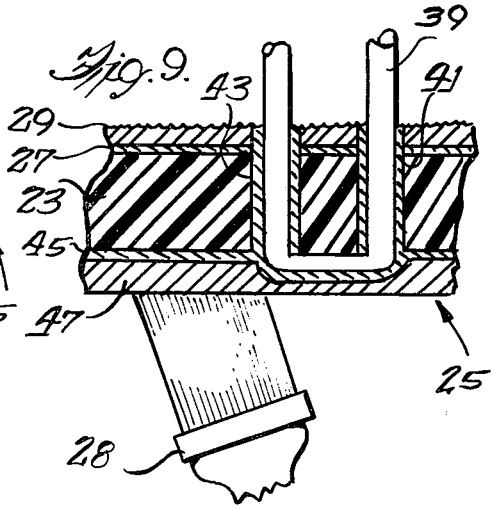
FIG. 9 is a side view of the unfinished hairpiece foundation, partially in section, presenting brush application of a fifth component to the inner or scalp-directed surface.

After the fourth component 45 has cooled to room temperature, a fifth component 47, a coating generically referred to as a specialty thermoplastic urethane in solution, is applied by the brush 28 to the inner or scalp-directed surface of the fourth component 45 (FIG. 9). The physical properties of a preferred coating (for the fifth component 47) appear below in Table V.

TABLE V

| GENERIC DESCRIPTION | PHYSICAL PROPERTIES: SOLUTION: TOTAL SOLIDS % | SOLUTION: VISCOSITY[26], CENTIPOISES AT 23° C. | FILM: 100% MODULUS, psi | FILM: ULTIMATE TENSILE STRENGTH, psi | FILM: ELONGATION % |
|---|---|---|---|---|---|
| Specialty Thermoplastic Urethane in Solution[25] (Coating) | 35 | 7000 | 1000 | >6000 | 450 |

[25]The solution is a clear, thermoplastic topcoat resin based on a solution polyurethane comprising a polyether and an aromatic diisocyante.
[26]The viscosity determination was made using a "Brookfield RVF Viscometer".

After the fifth component 47 has been applied entirely to the underside or scalp-directed surface of the hairpiece foundation 25 under construction, the hairpiece foundation is again placed into the oven 35 (FIG. 6), preset to about 200 Fahrenheit (93 Centigrade) degrees, for about 45 minutes to cure the fifth component 47.

Several layers of the fifth component 47 are preferably applied to the underside of the hairpiece foundation 25 under construction. The procedure is to apply a coating of the fifth component 47 and then to cure the hairpiece foundation 25 as outlined above. The hairpiece foundation 25 under construction is generally not cooled to room temperature between such applications of various layers of the fifth component 47.

The finished hairpiece foundation 25 preferably has two layers or coatings of the fifth component 47 applied to the pull-through area and has as few as three and as many as six (but preferably four) such layers applied to the knotted area. Before curing, the thickness of the fifth component 47 initially varies from about 4 mils to about 8 mils. After the last layer or coating of the fifth component 47 is applied to the hairpiece foundation 25 under construction, the hairpiece foundation 25 is cured as outlined above, and after being taken from the oven 35, cools in about 5 to about 10 minutes to room temperature. After curing, the thickness of the fifth component 47 varies from less than 1 mil to about 4 mils.

Figure 10:
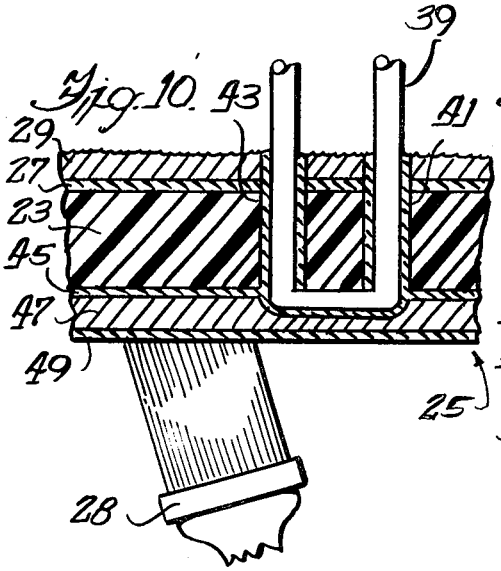
FIG. 10 is a side view of the unfinished hairpiece foundation, partially in section, presenting brush application of a sixth component.

After the hairpiece foundation 25 (under construction) has cooled to room temperature, a sixth component 49, an adhesive generically referred to as a polyurethane polymer in solution, is applied by the brush 28 to the entire inner or scalp-directed surface of the cured fifth component 47 (FIG. 10). The physical properties of the preferred sixth component 49 appear below in Table VI.

25, upon being taken out of the oven 35, cools in about 30 minutes to room temperature.

Upon cooling of the hairpiece foundation 25, the sixth component 49 solidifies and thereby bonds the seventh component 51 to the fifth component 47. Upon cooling, the thickness of the sixth component 49 is about 1 mil and the thickness of the seventh component 51 is slightly less than 10 mils.

The sixth component 49 is classified as an "open tack" adhesive. In the art, this means that at or above a predetermined temperature, the substantially solidified or cured adhesive substance (here, the sixth component

TABLE VI

| GENERIC DESCRIPTION | POLYMER PHYSICAL PROPERTIES | | | | | | | |
|---|---|---|---|---|---|---|---|---|
| | SPECIFIC GRAVITY[28] | HARDNESS[29], DUROMETER A | TENSILE STRENGTH[30], psi | MODULUS (ELONGATION), psi at 300% | MODULUS (ELONGATION), psi at 100% | ELONGATION, % | VISCOSITY[31] | HEAT RESISTANCE MINIMUM, °C. (°F.) |
| Polyurethane Polymer in Solution[27] (Adhesive) | 1.20 | 95 | 5600 | 1200 | 800 | 600 | 2100 to 3800 | 60 (140) |

[27]The polymer comprises thermoplastic polyester and polyether urethane elastomers which provide good physical and chemical properties without curing. The solution comprises about 20 volume percent polymer in about 80 volume percent solvent mixture. The preferred solvent mixture is 60 volume percent dimethyl formamide and 40 volume percent toluene. The solution includes about 2 percent, by weight (based upon weight of polymer and solvent mixture), of molecular sieves. Preferred molecular sieves are composed essentially of sodium aluminosilicate, have an initial pore size dimension of about 10 Angstroms, and are otherwise generally classified as being micron-sized, at least 99.9% passing through a 325 mesh screen.
[28]The specific gravity of a sample was determined using ASTM D-792 procedures.
[29]Hardness of a 75 mil tensile sheet was determined using ASTM D-2240 procedures.
[30]Hardness of a "dumbbell"film sample was determined using ASTM D-882 procedures.
[31]Viscosity determination was made upon a sample of 20% total solids (of polymer) in methyl ethyl ketone, using a "Brookfield RVF Viscometer" having a No. 2 spindle, and maintaining a temperature of 23 ± 1° C.

Figure 11:
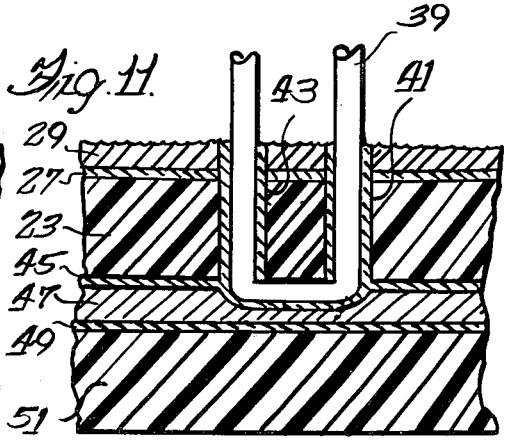
FIG. 11 is a side view of the finished foundation, partially in section, presenting a seventh component or layer as secured to the inner or scalp-directed surface of the sixth component.

As applied, the preferred sixth component 49 has an initial thickness of from about 1 mil to about 2 mils. After the sixth component 49 is entirely applied to the underside or scalp-directed side of the hairpiece foundation 25 (under construction), a seventh component 51, generically referred to as a thermoplastic polyurethane film, is secured to the underside or scalp-directed side of the hairpiece foundation 25 (under construction) by the sixth component 49, an adhesive (FIG. 11). The preferred polyurethane film is either polyester-based or polyether-based, depending upon the personal preference of the wearer. The physical properties of preferred films (for the seventh component 51) appear below in Table VII.

49) reverts to or again assumes the properties of a sticky or tacky substance. Yet, upon being permitted to cool to room temperature, the sticky or tacky (open-tack adhesive) again reverts to or assumes the properties of a solidified or cured adhesive substance. The preferred sixth component 49 (having the physical properties appearing above in Table VI) has an open-tack temperature of about 140 Fahrenheit (about 60 Centigrade) degrees.

The open-tack quality of the sixth component 49 of the hairpiece foundation 25 provides the hairpiece foundation 25 with an advantageous flexibility feature. For example, if for any reason, it is desirable to substitute a second seventh component 51 (not shown) for an initial

TABLE VII

| GENERIC DESCRIPTION | | PHYSICAL PROPERTIES | | | | | |
|---|---|---|---|---|---|---|---|
| | | SPECIFIC GRAVITY | DUROMETER HARDNESS, SHORE A UNITS | TENSILE STRENGTH[32], psi | ELONGATION AT BREAK[33], % | TEAR PROPAGATION[34], POUNDS/INCH | APPEARANCE |
| Thermoplastic Polyurethane (film) | Polyester Base | 1.22 | 93 | 9000 | 200 | 260 | Clear[35] |
| | Polyether Base | 1.14 | 82 | 6000 | 350 | | Frosty[36] |

[32]The tensile strengths were determined by performing ASTM D882-61T MD procedures upon test coupons.
[33]Elongation values were determined by performing ASTM D882-61T MD procedures upon test coupons.
[34]Tear propagation values were determined by performing ASTM D1938-62T MD procedures upon test coupons.
[35]A test coupon film thickness of 1 mil and 50 mils appeared clear and transparent.
[36]A test coupon film thickness of 1.5 mils and 55 mils appeared frosty and translucent.

The preferred seventh component 51 is initially about 10 mils thick. After the seventh component 51 has been secured to the inner or scalp-directed surface of the hairpiece foundation 25 by the sixth component 49, the entire hairpiece foundation 25 is again placed in the oven 35 and cured (FIG. 6) at a temperature of about 200 Fahrenheit (about 93 Centigrade) degrees for a time of about 1 to about 3 hours. The preferred curing time is about 2 hours. After curing, the hairpiece foundation seventh component 51, or if additional ventilation of the hairpiece foundation 25 is deemed necessary, such modifications or adaptations could easily be performed upon the hairpiece foundation 25 after removal of the initial or any subsequent seventh component 51.

Another advantage of the open-tack adhesive feature is for prolonging the useful life or overall attractive appearance of the hairpiece foundation 25.

Figure 2:
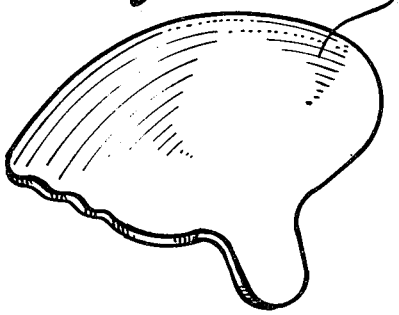
FIG. 2 is a perspective view of the base layer of the unfinished hairpiece foundation after such a base layer has been pre-formed or otherwise adapted to conform to the scalp curvature of a preselected human subject.

After the seventh component 51 has been bonded to the underside or scalp-directed side of the hairpiece foundation 25, the edge or perimeter of the hairpiece foundation 25 is trimmed to the initial row of hair (or to any desired hairline) of the individual wearer (FIG. 1).

If desired, the hair fibers 39 of the finished hairpiece foundation 25 can be tinted, dyed, or otherwise styled.

The preferred manner of securing the hairpiece foundation 25 to the scalp of the wearer is to apply commercially available double-sided adhesive tape, such as medical tape, to the underside or scalp-directed side of the finished hairpiece foundation 25 and then to apply the hairpiece foundation 25 to the scalp of the subject.

When the seven components 23, 27, 29, 45, 47, 49 and 51, having the preferred (or useful) physical properties outlined above in Tables I–VII are used to construct the hairpiece foundation 25, the finished hairpiece foundation 25 is highly resistant to perspiration, discoloration from tints or otherwise and microbiological attacks. Moreover, as all the components 23, 27, 29, 45, 47, 49 and 51 are individually substantially transparent (although collectively somewhat translucent, generally because of the hand-embossing), the finished hairpiece foundation 25 provides the wearer with an attractive scalp appearance. The hand-embossing provides the outside surface of the finished hairpiece foundation 25 with a pore-like appearance resembling human scalp tissue. In addition, the various components provide the hairpiece foundation 25 with a soft-to-the-hand quality, a flexible quality, and a surprisingly stable quality in extremes of temperature and weathering conditions. Furthermore, the finished hairpiece foundation 25 is highly resistant to tearing.

What has been illustrated and described herein is a novel hairpiece foundation. While the hairpiece foundation of the present invention has been illustrated and described with reference to preferred embodiments, the invention is not limited thereto. On the contrary, alternatives, changes or modifications may become apparent to those skilled in the art upon reading the foregoing description. Accordingly, such alternatives, changes or modifications are to be considered as forming a part of the invention insofar as they fall within the spirit and scope of the appended claims.

I claim:

1. A hairpiece foundation comprising: (a) a first sheet member of predetermined curvature; (b) a first adhesive bondable to said first sheet member; (c) a first coating having an effective amount of surface adaptations for providing said hairpiece foundation with an appearance of naturally-formed skin pores, said first coating being bonded to said first sheet member by said first adhesive; (d) a second adhesive bonded to said first sheet member; (e) a second coating bonded to said second adhesive; (f) a third adhesive bondable to said second coating, said third adhesive including an effective amount of molecular sieves for moisture control thereof; and (g) a second sheet member bonded to said second coating by said third adhesive, the foundation being translucent and having a natural appearance, said third adhesive being elevatable to a predetermined temperature above room temperature for releasing said second sheet member from said second coating.

2. A hairpiece foundation comprising: (a) a first sheet member of predetermined curvature having a first side and a second side opposite said first side; (b) a first adhesive bondable to said first side of said first sheet member; (c) a first coating having an effective amount of surface adaptations for providing said hairpiece foundation with an apparance of naturally-formed skin pores, said first coating being bonded to said first sheet member by said first adhesive; said first sheet member, said first adhesive and said first coating each including respectively therethrough a plurality of spaced holes having diameters relatively slightly greater than that of hair, each one of the plurality of first sheet member holes substantially co-aligning with a respective one of the plurality of first adhesive holes and with a respective one of the plurality of first coating holes; (d) a second adhesive bonded to said second side of said first sheet member, said second adhesive being penetrable into substantially each one of the plurality of holes of said first sheet member, of said first adhesive and of said first coating; (e) a second coating bonded to said second adhesive; (f) a third adhesive bondable to said second coating, said third adhesive including an effective amount of molecular sieves for moisture control thereof; and (g) a second sheet member bonded to said second coating by said third adhesive, the foundation being translucent and having a natural appearance, said third adhesive being elevatable to a predetermined temperature above room temperature for releasing said second sheet member from said second coating.

3. The hairpiece foundation of claim 1 or claim 2 wherein: (a) said first sheet member is a thermoplastic polyurethane film; (b) wherein said first adhesive is a silanol-based film priming adhesive; (c) wherein said first coating is an elastic organo-silicon-oxide high polymer; (d) wherein said second adhesive is an ethyl cyanoacrylate adhesive initially having a viscosity of from about 1 to about 5 centipoise; (e) wherein said second coating is a specialty thermoplastic urethane in solution; (f) wherein said third adhesive is a polyurethane polymer in solution; and (g) wherein said second sheet member is a thermoplastic polyurethane film.

4. The hairpiece foundation of claim 3 wherein said second sheet member is polyester based.

5. The hairpiece foundation of claim 3 wherein said second sheet member is polyether based.

6. The hairpiece foundation of claim 2 wherein said predetermined temperature is about 140 degrees Fahrenheit.

7. A soft-to-the-hand and flexible hairpiece foundation possessing surprising physical stability in extremes of temperature and weathering comprising: a first thermoplastic polyurethane film having a Durometer hardness of about 93 Shore A units; (a) a silanol-based film primer bondable to said first polyurethane film; an elastic organo-silicon-oxide high polymer having a Durometer hardness of about 25 Shore A Points bonded to said first polyurethane film by said film primer; an ethyl cyanoacrylate adhesive having a hardness of about 65 Barcol units bonded to said first polyurethane film; a specialty thermoplastic urethane in solution bonded to said ethyl cyanoacrylate adhesive; a polyurethane polymer in solution having a Durometer hardness of about 95 Shore A units bonded to said urethane in solution, said polyurethane polymer in solution including an effective amount of molecular sieves for moisture control thereof; and (f) a second thermoplastic polyurethane film bonded to said polyurethane polymer in solution, said polyurethane polymer in solution being elevatable to a predetermined temperature above room temperature for releasing said second polyurethane film from said urethane in solution.

8. The hairpiece foundation of claim 7 wherein an exterior surface of said organo-silicon-oxide high polymer is embossed and has an effective amount of surface adaptations for providing said hairpiece foundation with an appearance of naturally-formed skin pores.

9. The hairpiece foundation of claim 8 wherein: said first and said second thermoplastic polyurethane films are initially about 10 mils thick; wherein said silanol-based film primer is initially about ½ mil thick; wherein said organo-silicon-oxide high polymer is initially about 2 mils thick; wherein said ethyl cyanoacrylate adhesive is initially less than ½ mil thick; wherein said specialty thermoplastic urethane in solution is initially about 4 mils to about 8 mils thick; and wherein said polyurethane polymer in solution is initially about 1 mil to about 2 mils thick.

10. The hairpiece foundation of claim 9 wherein said second thermoplastic polyurethane film is polyester based and has a Durometer hardness of about 93 Shore A units.

11. The hairpiece foundation of claim 9 wherein said second thermoplastic polyurethane film is polyether based and has a Durometer hardness of about 82 Shore A units.

12. In combination with hair, a hairpiece foundation comprising: a first sheet member of predetermined curvature having a first side and a second side opposite said first side; a first adhesive bondable to said first side of said first sheet member; a first coating having an effective amount of surface adaptations for providing said hairpiece foundation with an appearance of naturally-formed skin pores, said first coating being bonded to said first sheet member by said first adhesive; said first sheet member, said first adhesive and said first coating each including respectively therethrough a plurality of spaced holes having diameters relatively slightly greater than that of said hair formed by ventilation of said hair respectively therethrough, each one of the plurality of first sheet member holes substantially co-aligning with a respective one of the plurality of first adhesive holes and with a respective one of the plurality of first coating holes; a second adhesive bonded to said second side of said first sheet member, said second adhesive being penetrable into substantially each one of the plurality of holes of said first sheet member, of said first adhesive and of said first coating for securing said hair respectively thereto; a second coating bonded to said second adhesive; a third adhesive bondable to said second coating, said third adhesive including an effective amount of molecular sieves for moisture control thereof; and a second sheet member bonded to said second coating by said third adhesive, the foundation being translucent and having a natural appearance, said third adhesive being elevatable to a predetermined temperature above room temperature for releasing said second sheet member from said second coating.

13. The combination of claim 12 wherein: said first sheet member is a first thermoplastic polyurethane film; wherein said first adhesive is a silanol-based film priming adhesive; wherein said first coating is an elastic organo-silicon-oxide high polymer; wherein said second adhesive is an ethyl cyanoacrylate adhesive initially having a viscosity of from about 1 to about 5 centipoise; wherein said second coating is a specialty thermoplastic urethane in solution; wherein said third adhesive is a polyurethane polymer in solution; and wherein said second sheet member is a second thermoplastic polyurethane film.

* * * * *